US005808542A

United States Patent [19]

Hwang

[11] Patent Number: 5,808,542

[45] Date of Patent: Sep. 15, 1998

[54] ALARM TONE GENERATING CIRCUIT FOR A RADIO PAGING RECEIVER

[75] Inventor: Seon-Woong Hwang, Kyungki-do, Rep. of Korea

[73] Assignee: Samsung Electronics Co. Ltd., Suwon, Rep. of Korea

[21] Appl. No.: 773,616

[22] Filed: Dec. 30, 1996

[30] Foreign Application Priority Data

Dec. 29, 1995 [KR] Rep. of Korea ..... 1995-64211

[51] Int. Cl.[6] ..... G08B 27/00

[52] U.S. Cl. ..... 340/384.7; 340/311.1; 340/636; 340/825.44; 455/343

[58] Field of Search ..... 340/311.1, 825.44, 340/324.7, 636; 455/38.3, 343

[56] References Cited

U.S. PATENT DOCUMENTS 4,237,448 12/1980 Weinberg ..... 340/384.7
4,755,816 7/1988 DeLuca ..... 340/311.1
5,150,415 9/1992 Jaffee et al. ..... 381/104
5,151,680 9/1992 Yamasaki ..... 340/311.1

*Primary Examiner*—Edward Lefkowitz
*Attorney, Agent, or Firm*—Dilworth & Barrese

[57] ABSTRACT

An alarm tone generating circuit for generating and controlling the intensity of an alarm tone during radio paging operations in a radio paging receiver, as the power supply voltage of a battery varies over time. The alarm tone generating circuit for a radio paging receiver includes: a power supply for supplying an operational power supply voltage of the radio paging receiver to components circuits thereof; a power supply detection signal generator for detecting variations of the operational power supply voltage over time and for generating a power supply detection signal; and an alarm tone level controller for controlling, in response to the power supply detection signal, the intensity of the alarm tone generated during radio paging operations of the radio paging receiver.

21 Claims, 2 Drawing Sheets

ALARM TONE GENERATING CIRCUIT FOR A RADIO PAGING RECEIVER

BACKGROUND OF THE INVENTION

1. Field of the Invention

The present invention relates to an alarm tone generating circuit for a radio paging receiver and in particular, to an alarm tone generating circuit for generating and controlling an alarm tone as the power supply varies over time.

An alarm tone generating circuit according to the present invention is based on Korean Application No. 64211/1995, which is incorporated herein by reference.

2. Description of the Related Art

In general, a radio paging receiver uses a battery as an operational power supply. However, over time, the operational energy of the battery is drained by typical usage by the radio pager. Thus, the intensity and/or volume of the alarm tone generated during radio paging operations may vary and even noticeably diminish. Consequently, when the power supply voltage of the battery becomes partially but not completely exhausted, the alarm tone of the radio paging cannot be generated.

SUMMARY OF THE INVENTION

It is therefore an object of the present invention to provide an alarm tone generating circuit for generating and controlling an alarm tone with improved operation over time regardless of typical draining of the power supply due to typical use.

To achieve the above object, the present invention is provided with an alarm tone generating circuit for a radio paging receiver, including: a power supply for supplying an operational power supply voltage of the radio paging receiver to respective component circuits; a power supply detection signal generator for detecting variations in the operational power supply voltage and for generating a power supply detection signal; and an alarm tone level controller for generating and controlling the intensity of the alarm tone during radio paging operations of the radio paging receiver in response to the power supply detection signal.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

In the following description, numerous specific details, such as components and operational steps of the illustrative circuits, are set forth to provide a more thorough understanding of the present invention. It will be apparent, however, to one skilled in the art that the present invention may be practiced without these specific details. The detailed description of known functions and devices in the prior art unnecessarily obscuring the subject matter of the present invention will be avoided in the present invention.

Figure 1:
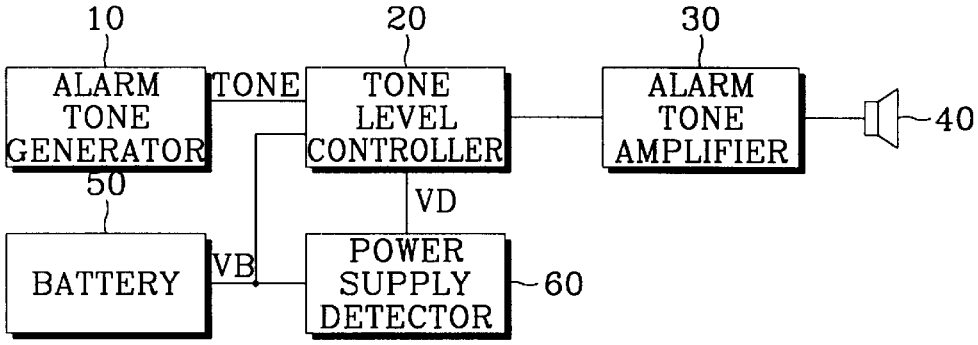
FIG. 1 is a block diagram showing an illustrative embodiment of a radio paging receiver according to the present invention.

FIG. 1 is a block diagram showing an illustrative embodiment of a radio paging receiver according to the present invention, which includes: a battery 50 for supplying to respective component circuits an operational power supply voltage VB for operating the radio paging receiver; a power supply detector 60 for detecting variations of the operational power supply voltage VB over time and for generating a power supply detection signal VD; an alarm tone generator 10 for generating an alarm tone TONE for performing the radio paging operations; an alarm tone level controller 20 for operating upon receiving the operational power supply voltage VB and for controlling the intensity of the alarm tone TONE of the alarm tone generator 10 in accordance with the power supply detection signal VD of the power supply detector 60; and an alarm tone amplifier 30 for amplifying the alarm tone TONE controlled by the alarm tone level controller 20 and for outputting the amplified tone to a speaker 40.

Herein, the disclosed alarm tone generating circuit is defined to include the power supply detector 60 and the alarm tone level controller 20.

Figure 2:
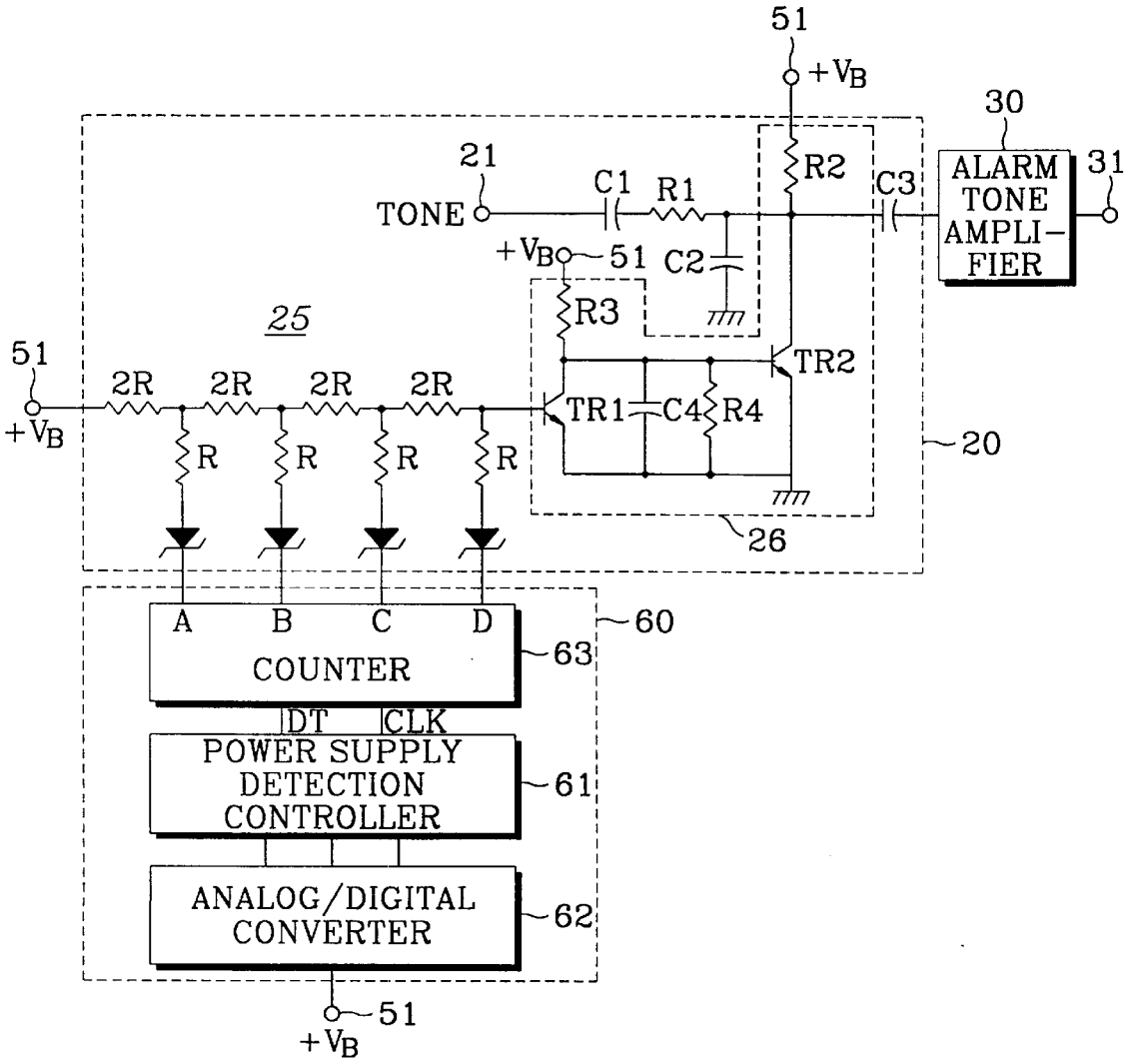
FIG. 2 is a block diagram showing in greater detail an illustrative embodiment of an alarm tone generating circuit of FIG. 1.

FIG. 2 is a block diagram showing in greater detail an illustrative embodiment of the alarm tone generating circuit of FIG. 1.

As shown in FIG. 2, the power supply detector 60 includes an analog/digital converter 62 which receives as an input the power supply voltage VB of the battery 50, which converts the inputted voltage into a digital power supply signal, and which outputs the converted signal to a power supply detection controller 61. The power supply detection controller 61 includes memory for storing therein dates or times DT as variation data corresponding to variations over time of the power supply voltage VB of the battery 50. A counter 63 generates a counter output signal corresponding to the variation data DT and inputs the generated counter output signal to a voltage controller 25 of the tone level controller 20, which may be implemented by a set of resistors, as shown in FIG. 2.

The voltage controller 25 receives the power supply voltage VB from the battery 50 as applied to a power supply terminal 51. The voltage controller 25 generates a control voltage according to the counter output signal of the counter 63 and inputs the control voltage to a voltage divider 26. In an illustrative embodiment, counter 63 generates a plurality of signals on a plurality of contacts A, B, C, D as the counter output signal to respective resistors of the voltage controller 25, such that the control voltage output to the voltage divider 26 is determined by the counter output signal generated on contacts A, B, C, D.

In the illustrative embodiment shown in FIG. 2, the voltage divider 26 and operation thereof are implemented according to the devices and methods disclosed in the U.S. Pat. No. 4,237,448, which is incorporated herein by reference.

Figure 3:
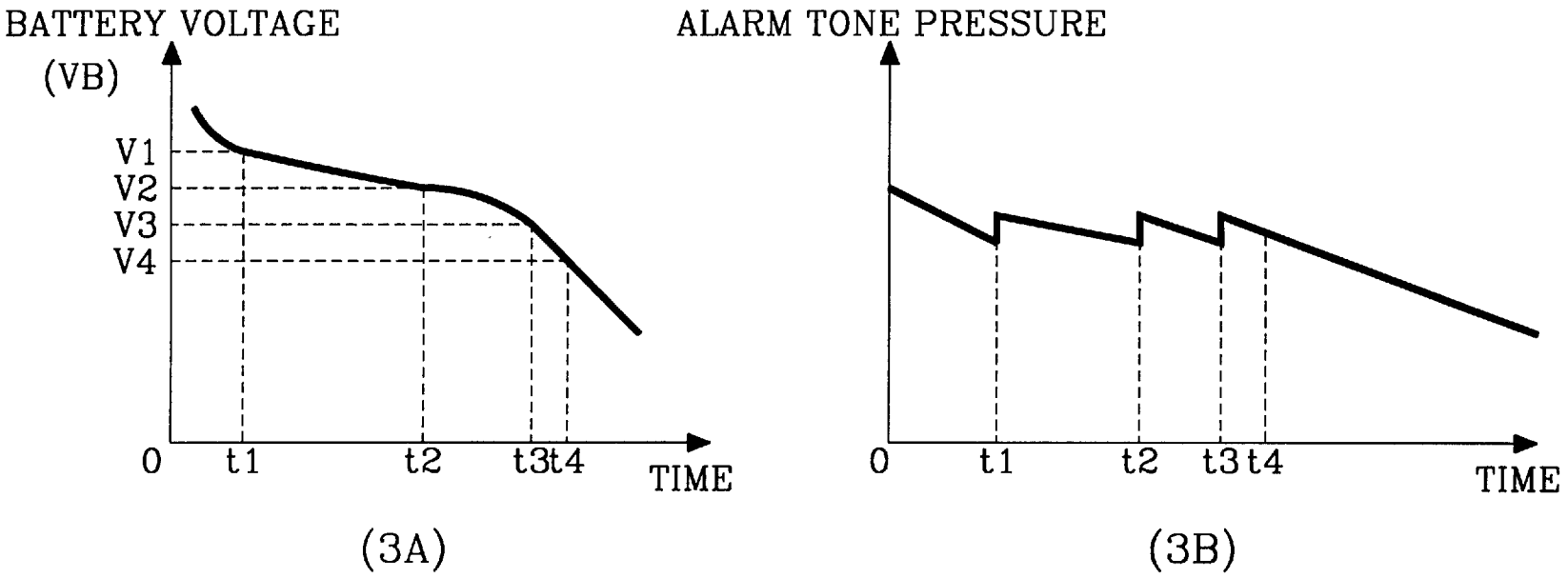
FIGS. 3A–3B are graphs of waveforms illustrating, respectively, a battery voltage and intensity of an alarm tone according to the present invention.

FIGS. 3A–3E are graphs of illustrative waveforms of a battery voltage and intensity of an alarm tone, respectively, according to the present invention, in which FIG. 3A illustrates the variation of the voltage VB over time, and FIG. 3B illustrates the variation of the alarm tone from the alarm tone generating circuit corresponding to the variation of the power supply voltage VB of the battery 50 over time to cause the amplification of the tone signal TONE to increase over time to compensate for the decrease in power supply voltage VB. The disclosed alarm tone generating circuit according to the present invention has an advantage in that the intensity of the alarm tone which typically decreases due to variation of the power supply voltage of the battery is compensated for by increased amplification of the TONE by the voltage divider 26.

As seen in FIGS. 3A–3B, preprogramming or wired circuitry of the alarm tone generating circuit may implement compensation of the TONE amplification at predetermined times t1, t2, t3, t4 corresponding to predetermined voltage levels v1, v2, v3, v4, respectively, over time. Accordingly, although the battery voltage VB typically decreases, the amplified tone intensity varies but generally is maintained within a predetermined range over time. Accordingly, the intensity of the tone is substantially constant, which may result in no perceptible decrease in intensity over time.

While there have been illustrated and described what are considered to be preferred embodiments of the present invention, it will be understood by those skilled in the art that various changes and modifications may be made, and equivalents may be substituted for elements thereof without departing from the scope of the present invention. In addition, many modifications may be made to adapt a particular situation to the teachings of the present invention without departing from the scope thereof. Therefore, it is intended that the present invention not be limited to the particular embodiment disclosed as the best mode contemplated for carrying out the present invention.

What is claimed is:

1. An alarm tone generating circuit for a radio paging receiver, comprising:

a power supply for supplying an operational power supply voltage to component circuits of the radio paging receiver for operation thereof;

a power supply detection signal generator for detecting variations over predetermined times for the operational power supply voltage and for generating a power supply detection signal corresponding to said variations over predetermined times of the operational power supply voltage; and an alarm tone level controller for receiving the operational power supply voltage and for controlling, in response to the power supply detection signal, the intensity of the alarm tone generated during radio paging operations of the radio paging receiver.

2. The alarm tone generating circuit as recited in the claim 1, wherein the power supply detection signal generator further comprises:

an analog/digital converter for converting the operational power supply voltage into a digital power supply signal;

a variation data generator for generating and storing variation data in a memory corresponding to variations of the operational power supply voltage over time; and a counter for generating a counter output signal corresponding to the variation data, wherein the alarm tone level controller, responsive to the counter output signal, controls the intensity.

3. The alarm tone generating circuit as recited in claim 2, wherein the alarm tone level controller further comprises:

a voltage generator for generating and varying a control voltage in relation to the counter output signal; and an alarm tone generator, responsive to the control voltage, for generating the alarm tone.

4. The alarm tone generating circuit as recited in the claim 3, wherein the voltage generator includes a plurality of resistors for generating the control voltage.

5. The alarm tone generating circuit as recited in the claim 3, wherein the alarm tone generator includes a voltage divider, responsive to the control voltage and the alarm tone, for adjusting the intensity of the alarm tone.

6. The alarm tone generating circuit as recited in the claim 2, wherein the counter generates a plurality of counter signals corresponding to the variation data at predetermined voltages levels of the operational power supply voltage.

7. The alarm tone generating circuit as recited in the claim 6, wherein the alarm tone level controller, responsive to the plurality of counter signals, controls the alarm tone to vary within a predetermined intensity range to provide a substantially constant alarm tone over time.

8. An alarm tone generating circuit comprising:

a power supply detection signal generator, responsive to an operational power supply voltage, for generating a power supply detection signal corresponding to variations of the operational power supply voltage over predetermined times;

an alarm tone generator for generating an alarm tone; and an alarm tone level controller for controlling, in response to the power supply detection signal, the intensity of the alarm tone to be within a predetermined intensity range.

9. The alarm tone generating circuit as recited in the claim 8, wherein the power supply detection signal generator further comprises:

a counter for generating a counter output signal corresponding to the variations in the operational power supply voltage; and wherein the alarm tone level controller, responsive to the counter output signal, controls the intensity of the alarm tone to be within the predetermined intensity range.

10. The alarm tone generating circuit as recited in the claim 9, wherein the alarm tone level controller further comprises:

a voltage generator for generating and varying a control voltage in relation to the counter output signal; and the alarm tone generator, responsive to the control voltage, generates the alarm tone having an intensity within the predetermined intensity range.

11. The alarm tone generating circuit as recited in the claim 10, wherein the voltage generator includes a plurality of resistors, responsive to a plurality of signals corresponding to the counter output signal, for generating the control voltage.

12. The alarm tone generating circuit as recited in the claim 10, wherein the alarm tone generator includes a voltage divider, responsive to the control voltage and the alarm tone, for adjusting the intensity of the alarm tone to be within the predetermined intensity range.

13. The alarm tone generating circuit as recited in the claim 9, wherein the counter generates a plurality of counter signals corresponding to the variation data at predetermined voltages levels of the operational power supply voltage.

14. The alarm tone generating circuit as recited in the claim 9, wherein the alarm tone level controller, responsive to the plurality of counter signals, controls the alarm tone to vary within the predetermined intensity range to provide a substantially constant alarm tone over time.

15. A method for generating an alarm tone comprising the steps of:

receiving an operational power supply voltage;

storing predetermined voltage values at corresponding predetermined times;

generating a power supply detection signal corresponding to variations of the operational power supply voltage from said stored predetermined voltage values over said predetermined times;

generating an alarm tone; and controlling, in response to the power supply detection signal, the intensity of the alarm tone to be within a predetermined intensity range.

16. The method recited in the claim 15, wherein:

the step of generating the power supply detection signal further includes the step of:

generating a counter output signal corresponding to the variations in the operational power supply voltage; and the step of controlling further includes the step of controlling, responsive to the counter output signal, the intensity of the alarm tone to be within the predetermined intensity range.

17. The method as recited in claim 16, wherein:

the step of controlling further comprises the step of:

generating a control voltage; and varying the control voltage in relation to the counter output signal; and the step of generating the alarm tone includes the step of generating, responsive to the control voltage, the alarm tone having an intensity within the predetermined intensity range.

18. The method as recited in the claim 17, wherein step of generating the control voltage includes the step of:

generating the control voltage using a plurality of resistors.

19. The method as recited in the claim 17, further comprising the step of:

adjusting, in response to the control voltage and the alarm tone, the intensity of the alarm tone to be within the predetermined intensity range using a voltage divider.

20. The method as recited in the claim 16, further comprising the step of:

generating a plurality of counter signals corresponding to the variation data at predetermined voltages levels of the operational power supply voltage.

21. The method as recited in the claim 20, wherein the step of controlling includes the step of controlling, responsive to the plurality of counter signals, the alarm tone to vary within the predetermined intensity range to provide a substantially constant alarm tone over time.

* * * * *